US006530099B1

(12) United States Patent
Iwinski

(10) Patent No.: US 6,530,099 B1
(45) Date of Patent: Mar. 11, 2003

(54) INJECTION MOLDED PLIERS WITH INSERT MOLDED DUAL PURPOSE REINFORCING AND IMPLEMENT STRUCTURE

(75) Inventor: Dean J. Iwinski, Muskege, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/619,755

(22) Filed: Jul. 19, 2000

(51) Int. Cl.[7] ..... B25B 7/22

(52) U.S. Cl. ..... 7/133; 7/134; 30/260; 81/416; 81/417; 81/421

(58) Field of Search ..... 7/133, 134; 81/415–418, 81/421; 30/260

(56) References Cited

U.S. PATENT DOCUMENTS

| | | | | |
|---|---|---|---|---|
| 419,911 | A | | 1/1890 | Bew |
| 3,082,652 | A | | 3/1963 | Marti |
| 3,161,085 | A | | 12/1964 | Pratt |
| 3,675,359 | A | | 7/1972 | Ohno |
| 3,776,071 | A | | 12/1973 | Krampe |
| 3,791,032 | A | | 2/1974 | Rogers |
| 3,833,953 | A | | 9/1974 | Fisher et al. |
| 3,971,131 | A | * | 7/1976 | Boyajian et al. ..... 30/260 |
| 4,023,450 | A | | 5/1977 | Ygfors |
| 4,250,620 | A | | 2/1981 | Nishikawa |
| 4,709,206 | A | | 11/1987 | Edwards et al. |
| 4,715,122 | A | | 12/1987 | Linden |
| 4,829,858 | A | | 5/1989 | Kern et al. |
| 5,092,074 | A | | 3/1992 | Zincke |
| 5,197,194 | A | * | 3/1993 | Sorensen et al. ..... 30/260 |
| 5,461,765 | A | | 10/1995 | Linden et al. |
| 5,485,641 | A | | 1/1996 | Machmeier et al. |
| 5,503,049 | A | | 4/1996 | Chervenak et al. |
| 5,556,150 | A | | 9/1996 | Ampel |
| 5,636,443 | A | | 6/1997 | Linden |
| 5,865,077 | A | | 2/1999 | Moffitt, Jr. |
| 6,038,772 | A | * | 3/2000 | Cornell et al. ..... 30/260 X |
| 6,202,518 | B1 | | 3/2001 | Moffitt, Jr. |

FOREIGN PATENT DOCUMENTS

| | | |
|---|---|---|
| CA | 1006041 | 3/1977 |

* cited by examiner

*Primary Examiner*—James G. Smith
(74) *Attorney, Agent, or Firm*—Seyfarth Shaw

(57) ABSTRACT

A composite pliers has crossed levers, each including a non-metallic body with an exposed metal cutter blade. The pliers includes strengthening and/or retaining structure around a pivot joint which does not extend into handle portions of the levers. This structure strengthens the pivot joint and can help confine the pliers parts in the event of failure. In one embodiment, each lever has a pivot joint strengthening structure insert molded therein, the structure extending into a jaw portion of each lever and protruding from the non-metallic body to form a workpiece engagement surface, such as a cutting blade. In one form, the jaws have more than one row of teeth with adjacent rows offset from each other. When the pliers is assembled from two identical lever members, each row of teeth on one lever will face the offset row of teeth on the other lever so that the peaks of the teeth on one lever fall within the grooves between the teeth on the opposing row. A non-metallic biasing structure is used to bias the jaws of the pliers open.

12 Claims, 4 Drawing Sheets

INJECTION MOLDED PLIERS WITH INSERT MOLDED DUAL PURPOSE REINFORCING AND IMPLEMENT STRUCTURE

BACKGROUND

The following relates to opposed-handle tools, such as pliers, cutters and the like, and particularly to tools formed of non-metallic materials. This has particular application to pliers, such as needlenose and lineman's pliers, of both the crimping and cutting types, which are designed for use in applications where they may be exposed to high electrical voltage or current.

Various types of opposed-handle tools have been available for working in applications where live current poses a danger of unpleasant shocks, or even death. Such opposed-handle tools include the types disclosed, e.g., in U.S. Pat. Nos. 5,556,150; 5,503,049; 5,484,641; 4,709,206; 4,023,450; 3,833,953; and 3,082,652. These prior composite opposed-handle tools all afford at least some degree of important electrically insulating, non-sparking and non-marring qualities. In order to withstand the forces normally applied to such tools, relatively large metal reinforcing structures are often provided that extend all the way from the workpiece engaging ends down into the handles. Such relatively large metal reinforcing structures can be undesirable in terms of electrical-sparking, weight, and manufacturing costs.

SUMMARY

An opposed-handle tool can comprise levers formed almost entirely of non-metallic material with a metal reinforcing structure embedded in the levers around the pivot joint.

An opposed-handle tool can further comprise a pivot mechanism passageway cooperatively formed by a first opening in the first reinforcement structure and respective second and third openings in the first and second pivot joint portions. The pivot mechanism can be inserted in the pivot mechanism passageway and used to interconnect the first and second pivot joint portions. The first opening can be sized and shaped to allow the first reinforcement structure to engage the pivot mechanism and the second and third openings can be sized and shaped to minimize engagement between the pivot joint portions and the pivot mechanism.

The disclosed opposed-handle tool consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the disclosed opposed-handle tool.

BRIEF DESCRIPTION OF THE DRAWINGS

For the purpose of facilitating an understanding of the disclosed opposed-handle tool, there is illustrated in the accompanying drawings an embodiment thereof, from an inspection of which, when considered in connection with the following description, its construction and operation, and many of its advantages should be readily understood and appreciated.

DETAILED DESCRIPTION

Figure 1:
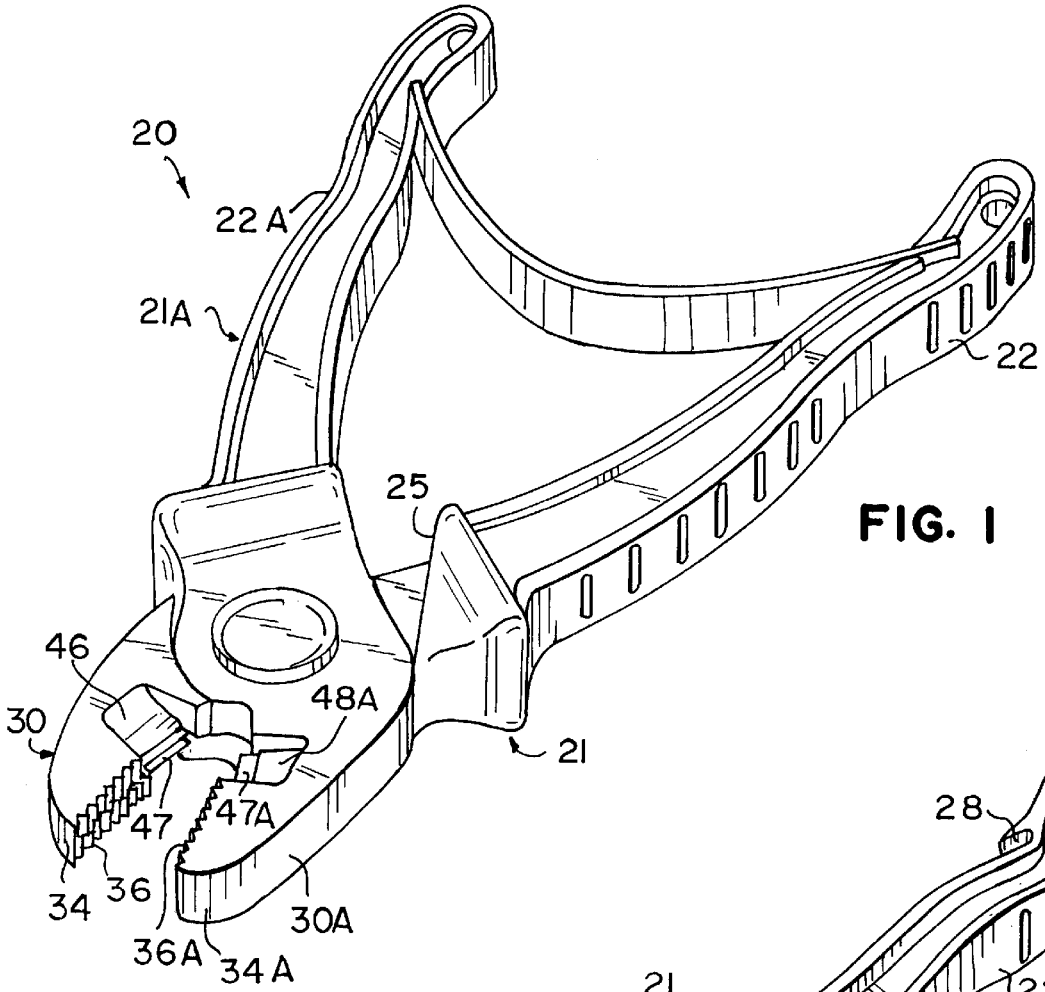
FIG. 1 is a perspective view of one form of the pliers described herein.
Figure 3:
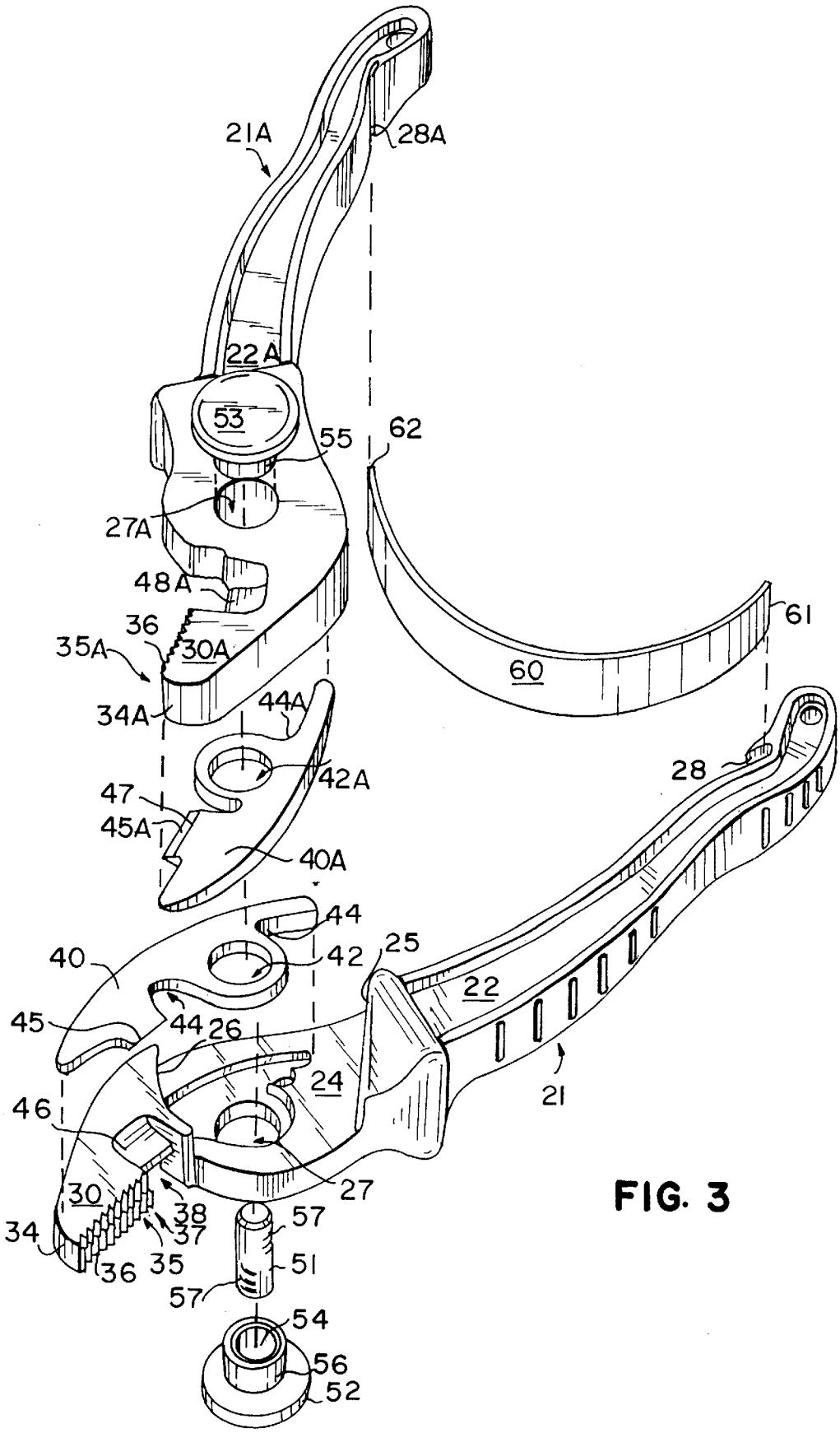
FIG. 3 is an exploded perspective view of the pliers of FIG. 1.
Figure 4:
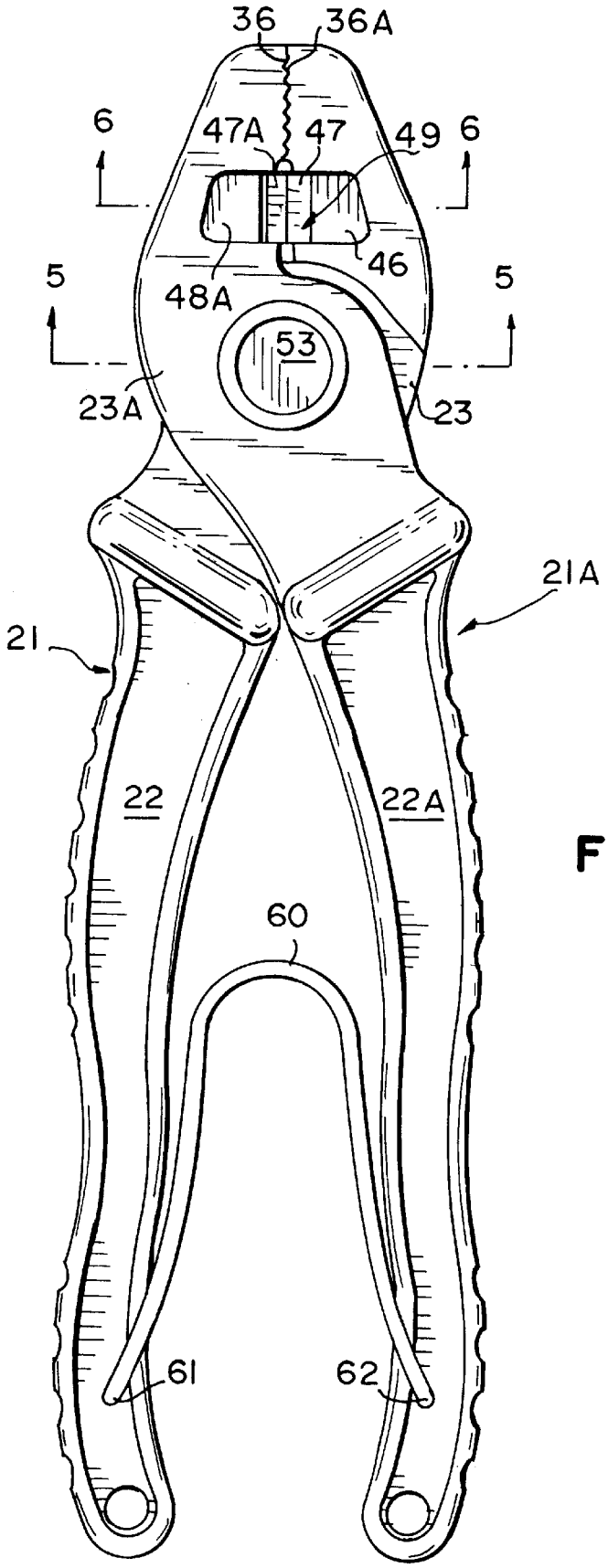
FIG. 4 is an enlarged top plan view of the pliers of FIG. 1.

Referring to FIGS. 1, 3 and 4, there is illustrated an opposed-handle tool, such as a pivotal hand tool in the nature of a plier/cutter tool 20. The tool 20 includes a pair of elongated lever members 21 and 21A which are substantially identical in construction. Accordingly like parts of the lever members 21 and 21A bear the same reference numbers with the reference numbers of the lever member 21A bearing the suffix "A" for purposes of distinguishing the two lever members. The following description will be principally with respect to the lever member 21, and it will be appreciated that, although they may not all be specifically mentioned, the lever member 21A has like parts.

Figure 2:
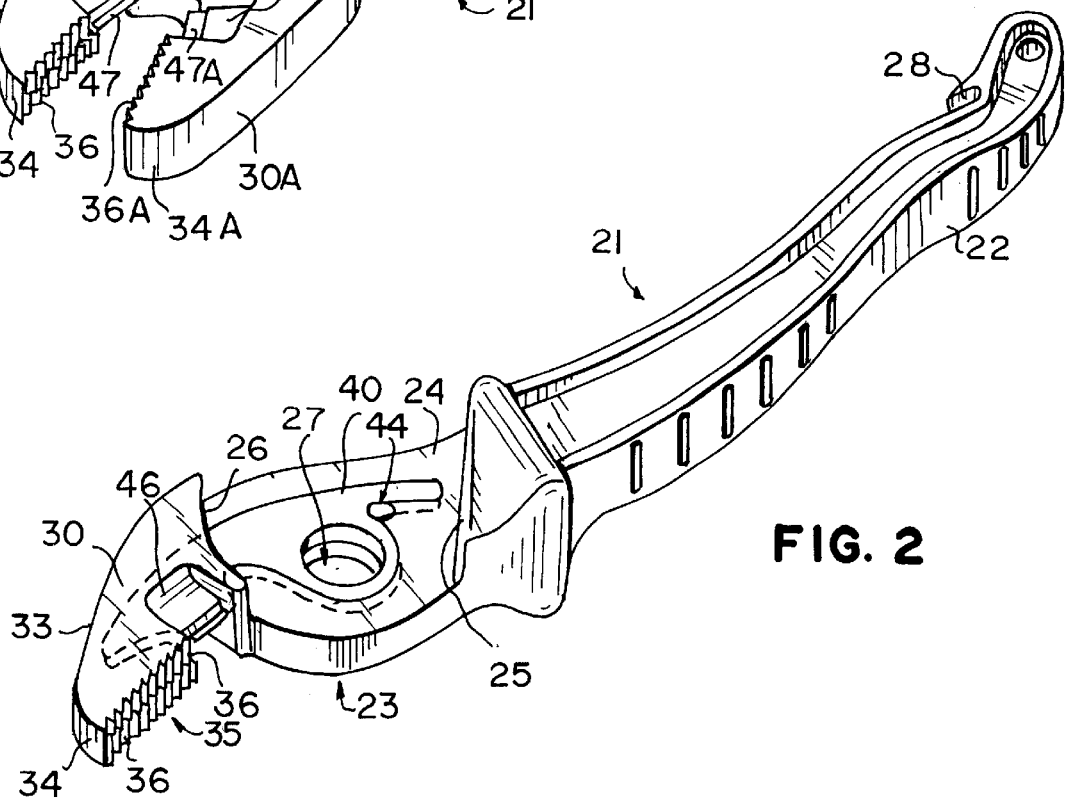
FIG. 2 is a perspective view of one lever of the pliers of FIG. 1.

Referring also to FIG. 2, the lever member 21 includes an elongated handle portion 22 at one end thereof and a workpiece engaging end, such as jaw 30, at the other end thereof. Handle portion 22 and jaw 30 are interconnected by a reduced-thickness pivot joint portion 23, which has a flat, planar inner surface 24 bounded at the rearward and forward ends thereof, respectively, by shoulder walls 25 and 26. Formed through the pivot joint portion 23 is a cylindrical bore 27, that can have a circular, or different shaped, cross-section. In one form, a slot 28 is provided proximate the end of handle portion 22 that is furthest from jaw 30.

Figure 5:
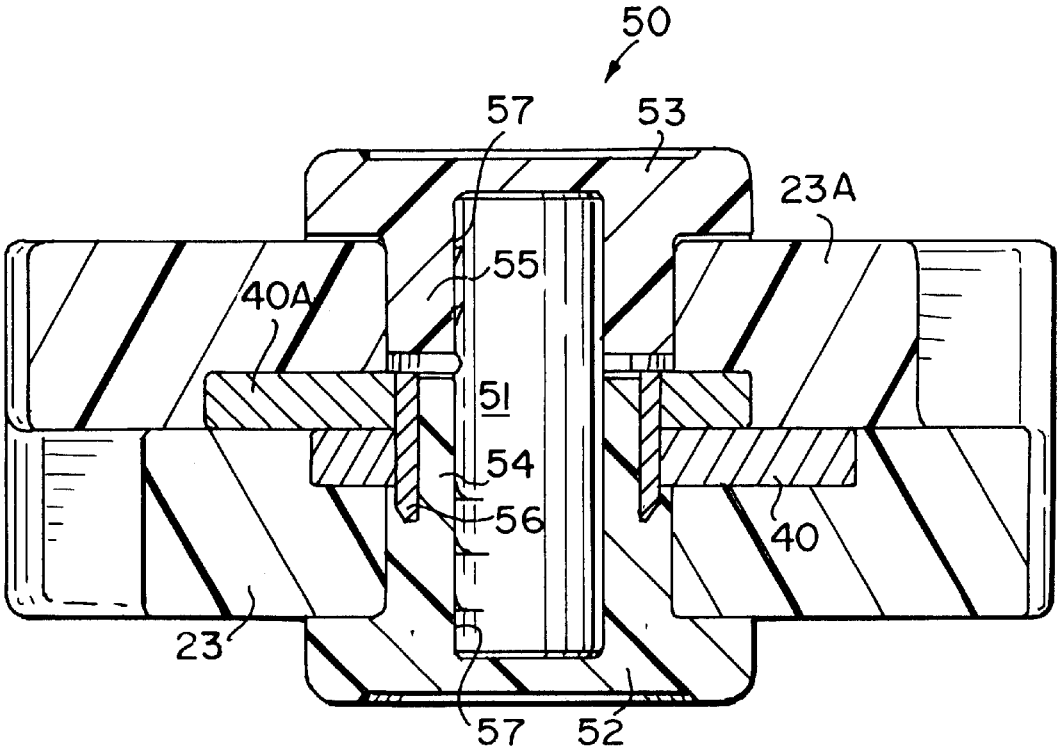
FIG. 5 is an enlarged sectional view taken along the line 5—5 in FIG. 4.
Figure 6:
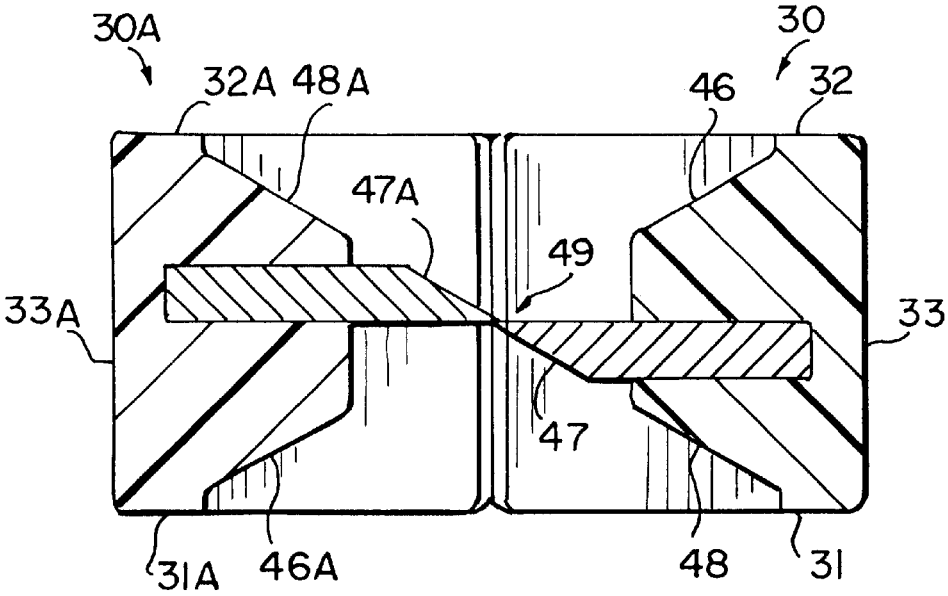
FIG. 6 is an enlarged sectional view taken along the line 6—6 in FIG. 4.

Referring also to FIGS. 5 and 6, the jaw 30 has substantially parallel side surfaces 31 and 32 interconnected by an outer surface 33, which terminates at the forward end of the jaw 30 in a nose surface portion 34. The side surfaces 31 and 32 are also interconnected by a serrated inner surface portion 35 which is opposite the outer surface 33 and has a plurality of transversely extending, sawtooth-shaped serrations or teeth 36 formed therein to provide a gripping surface. Serrated inner surface portion 35 can comprise two rows 37, 38 of sawtooth-shaped teeth 36, wherein the teeth in each row are slightly offset from one another.

The lever member 21 can be of a unitary, one-piece construction, being formed of a non-metallic, non-conducting or electrically resistant composite plastic material, such as a 60% glass-fiber reinforced nylon plastic material known by the trade name GRIVORY and believed to be available through EMS-American Grilon, Inc. In one form, the lever members 21 and 21A are formed by injection molding, but it will be appreciated that other types of molding could be used.

Referring also to FIGS. 2, 3, 5 and 6, there are respectively fixedly secured to the pivot joint portions 23 and 23A of lever members 21 and 21A, as by a insert molding, two reinforcement structures, such as inserts 40 and 40A, which are substantially identical in construction. Thus, the parts of the insert 40A bear the same reference numerals as the like parts of the insert 40, but with a suffix "A", but the description will be principally in terms of the insert 40, in the same manner as is described above in connection with the lever members 21 and 21A.

In one form, insert 40 is of unitary, one-piece construction and made from steel. However, the insert can also be formed of any other suitable material. The insert 40 is disposed in the pivot joint and can be substantially parallel to the inner surface 24 thereof. Each insert 40 has a bore 42 therethrough disposed substantially congruent to the cylindrical bore 27 in the associated pivot joint portion 23 or 23A. In one form, bores 27 and 42 both have a circular cross-section having the same axis, with the circular cross-section of bore 42 being smaller in diameter than the circular cross-section of cylindrical bore 27. Each insert 40 can be disposed in the associated pivot joint portion 23 or 23A so that the top of insert 40 is in the same plane as, or protrudes slightly above, inner surface 24.

Each reinforcing insert 40 can be of a complex shape with one or more indentations 44, openings and/or protrusions 45, which can be filled, or surrounded, with the plastic material as the inserts 40 are insert molded, thereby anchoring the reinforcing insert 40 in the lever member 21 and helping to prevent pieces of the pivot joint portion 23 from breaking off in the event of an overload failure. In one form, insert 40 is sized and shaped to substantially surround the cylindrical bore 27 in pivot joint portion 23 in order to provide added strength to the pivot joint portion and does not extend any substantial amount into handle portion 22. As illustrated in FIG. 2, insert 40 can be designed so that it does not extend into handle portion 22 at all. The various indentations 44, openings, or protrusions 45 can be used as alignment surfaces to engage positioning surfaces (not shown) in the mold. In one form, at least two alignment surfaces are used in order to properly align insert 40 when insert 40 is insert molded. The interior of bore 42 can also be used as a third alignment surface.

Insert 40 can extend into jaw 30 in order to strengthen jaw 30 and/or to provide a workpiece engagement structure, such as a blade 47 of a wire cutter 49 or a wire crimper, that protrudes from the material that forms the rest of jaw 30. In another form, insert 40 does not form a blade 47 protruding from the material that forms the rest of jaw 30. Instead, insert 40 is not exposed to the environment when tool 20 is assembled.

In one form, the workpiece engagement structure can be formed from one of the positioning surfaces, such as protrusion 45. Such protrusion 45 can be in an unsharpened state when used as a positioning surface. After insert molding, the tool 20 can be assembled with the protrusions 45 and 45A left unsharpened in order to form wire crimpers (not shown). If wire cutters are desired, the protrusions 45 and 45A can be sharpened (before or after tool 20 are assembled) in order to form blades 47 and 47A.

It is advantageous to provide at least one surface 46 on jaw 30 that slopes toward protrusion 45 or blade 47 and forms an access way to allow easier access to sharpen protrusion 45 or blade 47. A second sloping surface 48 can be provided opposite surface 46 to allow both sides of protrusion 45 or blade 47 to be sharpened and to allow cut wire to be easily extracted from tool 20.

In assembly of the lever members 21 and 21A, they are arranged in intersecting relationship, with the pivot joint portions 23 and 23A overlapping, with the inner surfaces 24 and 24A in facing relationship and with the bores 27, 27A, 42 and 42A coaxially aligned. The lever members 21 and 21A can then be pivotally interconnected by a pivot assembly 50 (FIGS. 3 and 5), which includes a pin 51 and two non-conducting caps, such as plastic heads 52 and 53. Plastic heads 52 and 53 can further comprise a deformable plastic tube 54 and 55. In one form, at least one barb 57 is provided on each end of pin 51 to engage the deformable plastic, thereby keeping the pin 51 and heads 52, 53 together.

A first end of pin 51 is inserted into head 52, such as into the attached deformable plastic tube 54, and the resulting coupling is inserted into the pivot mechanism passageway, comprising the aligned bores 27, 27A, 42 and 42A, through the tool 20. Head 53 is then placed in position so that the second end of pin 51 can be inserted into deformable plastic tube 55 until each head 52 and 53 is held firmly against one of the outer surface of one of the lever members 21 and 21A. Thus, the pin 51, deformable plastic tubes 54, 55 and the heads 52, 53 cooperate to define a pivot shaft interconnecting the lever members 21 and 21A for pivotal movement between the closed condition illustrated in FIG. 4 and an open condition illustrated in FIG. 1. The pin 51 is inserted into heads 52 and 53 until the parts are firmly secured together while allowing substantially free pivotal movement. The heads 52, 53 are formed of an electrically non-conducting material, such as a suitable plastic or rubber, and they cooperate with the pivot joint portions 23 and 23A to completely enclose the pivot assembly 50, so that no metallic portion thereof is exposed.

In one form, a wear resistant shaft 56 surrounds at least one of deformable plastic tubes 54 and 55. When assembled, the wear resistant shaft 56 engages bores 42 and 42A, whereas other portions of the heads 52 and 53 have a small gap between them and the plastic material defining cylindrical bores 27 and 27A that surround them. This enables the wear resistant surfaces of shaft 56 and insert 40 and 40A to prevent excessive wear by accepting most of the frictional forces as the pliers are used. Even if heads 52 and 53 engage the plastic material defining cylindrical bores 27 and 27A, the plastic material will wear during initial use and eventually shaft 56 and inserts 40 and 40A will take most of the wearing forces. In a similar fashion, the pin 51 cab be made of a suitable wear resistant material and, after being inserted in heads 52 and 53, a portion can be left exposed for engagement with inserts 40 and 40A.

When the parts are thus assembled, the inserts 40 and 40A are disposed in opposed facing relationship so that, when the jaws 30 and 30A are closed, the outer surfaces of the inserts 40 and 40A will be disposed in an abutting, substantially coplanar relationship. If inserts 40 and 40A extend slightly above inner surfaces 24 and 24A, then inserts 40 and 40A will protect inner surfaces 24 and 24A from wear due to friction as the tool 20 is used. Even if the outer surfaces of the inserts 40 and 40A are coplanar with, or even recessed below, inner surfaces 24 and 24A, the plastic material forming inner surfaces 24 and 24A will wear down during initial use and then inserts 40 and 40A will reduce further wear.

In one form, insert 40 is disposed in the pivot joint at a slight angle with respect to the rest of tool 20 or inner surface 24, such that protrusion 45 is raised slightly above inner surface 24 and is slightly elevated from the portion of the insert near indentation 44. When tool 20 is assembled from identical components, protrusions 45 and 45A are slightly offset from one another such that they are not in the same plane, as seen most clearly in FIG. 6. This allows protrusions 45 and 45A to slide over one another, thereby allowing tool 20 to fully close. Utilizing a design that allows protrusions 45 and 45A to overlap also allows protrusions 45 to protrude sufficiently outside the plastic material to allow material to be cut away to make a cutter, wire stripper or crimper. Even when a portion is cut away to form blade 47, a sufficient overlap can be provided such that there is enough material exposed to allow multiple re-sharpenings of blades 47 and 47A.

It will be appreciated that the teeth 36 and 36A define cooperating gripping surfaces for gripping associated workpieces in a known manner. However, using two offset rows 37 and 38 (and 37A and 38A) on each lever member 21 and 21A allows the lever members to be manufactured as identical parts without any detrimental performance. In this situation, when the identical parts are assembled into tool 20, then teeth 36 of row 37 interlay with the teeth 36A (not shown) of row 38A (not shown) and the teeth 36 of offset row 38 interlay with the teeth 36A of row 37A (not shown), as best seen in FIG. 4. In other words, teeth 36 in lever member 21 will lay in the gaps between teeth 36A of lever member 21A, and vice versa. Otherwise, if only one row of teeth 36 is used and the tool is assembled from identical lever members 21 and 21A, then teeth 36 would contact teeth 36A and prevent the tool 20 from fully closing. The interlaying of teeth 36 and 36A prevents excessive wear from repeated contact between both rows of teeth, as would likely occur with conventional designs where teeth from opposite jaws contact one another when a pliers is fully closed. The interlaying of teeth 36 and 36A also provides an exceptionally strong grip on some thin soft surfaces even as teeth 36 and 36A become worn.

In one form, a channel or groove (not shown) is provided between rows 37 and 38. Such a groove further allows the tool 20 to be closed more fully by minimizing contact between the edges of teeth 36 that are nearest the groove in lever member 21 and the edges of teeth 36A that are nearest the groove in lever member 21A. This prevents the edges of teeth 36 and 36A from catching on one another and preventing the pliers from closing.

A biasing member 60 can be provided with tool 20 to bias jaws 30 and 30A in the open position seen in FIG. 1. In one form, biasing member 60 is rectangular in shaped and comprised of a suitable flexible non-metallic, non-conducting material having a memory, such as acetal. Biasing member 60 is bent into an arch and a first end 61 is inserted in slot 28 of lever member 21 and the second end 62 is inserted in slot 28A of lever member 21A. In one form, the slots 28, 28A and biasing member 60 are sized so that a friction fit can be used to keep biasing member 60 in place. In an alternative form, slots 28, 28A and ends 61, 62 can be designed to snap-fit in place. Neither alternative requires the use of metal fasteners.

Except for the pivot assembly 50 and the inserts 40, 40A, the plier/cutter tool 20 has no metallic parts, being formed substantially entirely of electrically insulating, non-sparking, non-corroding materials, which are lightweight and non-magnetic.

From the foregoing, it can be seen that there has been provided an improved pivoting hand tool which is of simple and economical construction, and which is largely non-electrically conductive, lightweight, non-sparking, non-magnetic and corrosion resistant, while providing gripping and cutting surfaces which have strength, hardness, toughness and wear resistance. The forgoing improved pivoting hand tool provides a strengthened hand tool with cutters that can be sharpened, while minimizing the amount of metallic material used and exposed.

I claim:

1. An opposed-handle tool comprising:

a first lever formed entirely of non-metallic material, and including a first handle, a first workpiece-engaging end and a first pivot joint portion therebetween;

a second lever formed entirely of non-metallic material, and including a second handle, a second workpiece-engaging end and a second pivot joint portion therebetween;

a first reinforcement structure embedded in the first pivot joint portion with no portion of the first reinforcement structure being embedded in the first handle;

a pivot mechanism interconnecting the first and second pivot joint portions, the pivot mechanism having no exposed metallic portions when the tool is assembled; and a pivot mechanism passageway cooperatively formed by a first opening in the first reinforcement structure and respective second and third openings in the first and second pivot joint portions;

the pivot mechanism being disposed in the pivot passageway and interconnecting the first and second pivot joint portions; and wherein the first opening is sized and shaped to allow the first reinforcement structure to engage the pivot mechanism and the second and third openings are sized and shaped to minimize engagement between the joint portions and the pivot mechanism.

2. The opposed-handle tool of claim 1, wherein the first, second and third openings are circular and the second and third openings are larger than the first opening.

3. The opposed-handle tool of claim 1, wherein the pivot mechanism includes:

a first non-metallic head coupled to the first lever proximate a first end of the pivot mechanism passageway;

a second non-metallic head coupled to the second lever proximate a second end of the pivot mechanism passageway; and a wear resistant shaft coupled to the first and second non-metallic heads, the wear resistant shaft sized and shaped to engage a portion of the first reinforcement structure surrounding the first opening.

4. An opposed-handle tool comprising:

a first lever formed entirely of non-metallic material, and including a first handle, a first workpiece-engaging end and a first pivot joint portion therebetween;

a second lever formed entirely of non-metallic material, and including a second handle, a second workpiece-engaging end and a second pivot joint portion therebetween;

a first reinforcement structure embedded in the first pivot joint portion with no portion of the first reinforcement structure being embedded in the first handle;

a pivot mechanism interconnecting the first and second pivot joint portions, the pivot mechanism having no exposed metallic portions when the tool is assembled; and a pivot mechanism passageway cooperatively formed by a first opening in the first reinforcemuent structure and respective second and third openings in the first and second pivot joint portions;

the pivot mechanism being disposed in the pivot passageway and interconnecting the first and second pivot joint portions; and wherein the first opening is sized and shaped to allow the first reinforcement structure to engage the pivot mechanism and the second and third openings are sized and shaped to minimize engagement between the pivot joint portions and the pivot mechanism;

the pivot mechanism including a first non-metallic head coupled to the first lever proximate a first end of the pivot mechanism passageway, a second non-metallic head coupled to the second lever proximate a second end of the pivot mechanism passageway, a wear resistant shaft coupled to the first and second non-metallic heads, the wear resistant shaft sized and shaped to engage a portion of the first reinforcement structure surrounding the first opening, a first deformable connector coupled to the first non-metallic head, a second deformable connector coupled to the second non-metallic head, and a barbed connector, including a plurality of barbs, connecting the first and second deformable connectors, and wherein a first barb engages the first deformable connector and a second barb engages the second deformable connector.

5. The opposed-handle tool or claim 4 wherein the first and second deformable connectors are female connectors and the barbed connector is a male connector.

6. An opposed-handle tool comprising:

a first lever formed entirely of non-metallic material, and including a first handle, a first workpiece-engaging end and a first pivot joint portion therebetween;

a second lever formed entirely of non-metallic material, and including a second handle, a second workpiece-engaging end and a second pivot joint portion therebetween;

a first reinforcement structure embedded in the first pivot joint portion with no portion of the first reinforcement structure being embedded in the first handle; and a pivot mechanism interconnecting the first and second pivot joint portions, the pivot mechanism having no exposed metallic portions when the tool is assembled;

wherein the first workpiece-engaging end comprises a first jaw having a first row of tooth-like serrations and a second row of tooth-like serrations offset from the first row, the second workpiece-engaging end comprises a second jaw having a third row of tooth-like serrations and a fourth row of tooth-like serrations offset from the third row, and wherein the first row of tooth-like serrations intermeshes with the third row of tooth-like serrations and the second row of tooth-like serrations intermeshes with the fourth row of tooth-like serrations when the first and second jaws are in a closed position.

7. The opposed-handle tool of claim 6, and further comprising a first groove separating the first and second rows of tooth-like serrations and a second groove separating the third and fourth rows of tooth-like serrations.

8. An opposed-handle tool comprising:

a first lever including a first handle, a first workpiece-engaging end and a first pivot joint portion therebetween;

a second lever including a second handle, a second workpiece-engaging end and a second pivot joint portion therebetween;

a first reinforcement structure embedded in the first pivot joint portion; and a pivot mechanism interconnecting the first and second pivot joint portions, the pivot mechanism comprising:

a pivot mechanism passageway cooperatively formed by a first opening in the first reinforcement structure and respective second and third openings in the first and second pivot joint portions;

the pivot mechanism being disposed in the pivot passageway and interconnecting the first and second pivot joint portions; and wherein the first opening is sized and shaped to allow the first reinforcement structure to engage the pivot mechanism and the second and third openings are sized and shaped to minimize engagement between the pivot joint portions and the pivot mechanism.

9. The opposed-handle tool of claim 8, wherein the pivot mechanism includes:

a first head coupled to the first lever proximate a first end of the pivot mechanism passageway;

a second head coupled to the second lever proximate a second end of the pivot mechanism passageway; and a wear resistant shaft coupled to the first and second non-metallic heads, the wear resistant shaft sized and shaped to engage a portion of the first reinforcement structure surrounding the first opening.

10. The opposed-handle tool of claim 9 wherein the pivot mechanism includes:

a first deformable connector coupled to the first head;

a second deformable connector coupled to the second head; and a barbed connector, including a plurality of barbs, connecting the first and second deformable connectors, and wherein a first barb engages the first deformable connector and a second barb engages the second deformable connector.

11. An opposed-handle tool comprising:

a first lever including a first handle, a first workpiece-engaging end and a first pivot joint portion therebetween;

a second lever including a second handle, a second workpiece-engaging end and a second pivot joint portion therebetween; and a pivot mechanism interconnecting the first and second pivot joint portions;

wherein the first workpiece-engaging end comprises a first jaw having a first row of tooth-like serrations and a second row of tooth-like serrations offset from the first row, the second workpiece-engaging end comprises a second jaw having a third row of tooth-like serrations and a fourth row of tooth-like serrations offset from the third row, and wherein the first row of tooth-like serrations intermeshes with the third row of tooth-like serrations and the second row of tooth-like serrations intermeshes with the fourth row of tooth-like serrations when the first and second jaws are in a closed position.

12. The opposed-handle tool of claim 11, and further comprising a first groove separating the first and second rows of tooth-like serrations and a second groove separating the third and fourth rows of tooth-like serrations.

* * * * *

UNITED STATES PATENT AND TRADEMARK OFFICE

CERTIFICATE OF CORRECTION

PATENT NO. : 6,530,099 B1
DATED : March 11, 2003
INVENTOR(S) : Dean J. Iwinski et al.

It is certified that error appears in the above-identified patent and that said Letters Patent is hereby corrected as shown below:

Title page,
Item [56], References Cited, FOREIGN PATENT DOCUMENTS, "CA" should be -- FR --.

Column 7,
Line 14, "or" should be -- of --.

Signed and Sealed this

Eighth Day of July, 2003

JAMES E. ROGAN
*Director of the United States Patent and Trademark Office*